US007826630B2

(12) United States Patent
Yamada et al.

(10) Patent No.: US 7,826,630 B2
(45) Date of Patent: Nov. 2, 2010

(54) SOUND IMAGE LOCALIZATION APPARATUS

(75) Inventors: Yuji Yamada, Tokyo (JP); Koyuru Okimoto, Tokyo (JP)

(73) Assignee: Sony Corporation (JP)

( * ) Notice: Subject to any disclaimer, the term of this patent is extended or adjusted under 35 U.S.C. 154(b) by 1384 days.

(21) Appl. No.: 11/150,999

(22) Filed: Jun. 13, 2005

(65) Prior Publication Data

US 2005/0286724 A1 Dec. 29, 2005

(30) Foreign Application Priority Data

Jun. 29, 2004 (JP) ..... P2004-191952

(51) Int. Cl.
*H04R 5/02* (2006.01)
*H04R 1/10* (2006.01)

(52) U.S. Cl. ..... 381/309; 381/310; 381/74

(58) Field of Classification Search ..... 381/17, 381/18, 309, 74, 310, 307, 303
See application file for complete search history.

(56) References Cited

U.S. PATENT DOCUMENTS

| | | | | |
|---|---|---|---|---|
| 5,982,903 | A * | 11/1999 | Kinoshita et al. | 381/18 |
| 6,026,169 | A * | 2/2000 | Fujimori | 381/61 |
| 6,590,983 | B1 * | 7/2003 | Kraemer | 381/18 |
| 2003/0076973 | A1 * | 4/2003 | Yamada | 381/309 |
| 2003/0076983 | A1 | 4/2003 | Yamada | 381/309 |
| 2003/0215104 | A1 | 11/2003 | Yamada et al. | 381/309 |

FOREIGN PATENT DOCUMENTS

| | | | |
|---|---|---|---|
| JP | 54-109402 | A | 8/1979 |
| JP | 04-030700 | A | 2/1992 |
| JP | 06-285258 | A | 10/1994 |
| JP | 09-182200 | A | 7/1997 |
| JP | 10-174200 | A | 6/1998 |
| JP | 11-055799 | A | 2/1999 |
| JP | 11-103500 | A | 4/1999 |
| JP | 2000-227350 | A | 8/2000 |
| JP | 2002-209300 | A | 7/2002 |
| JP | 2003-061195 | A | 2/2003 |
| JP | 2003-102099 | A | 4/2003 |

* cited by examiner

*Primary Examiner*—Xu Mei
*Assistant Examiner*—Paul Kim
(74) *Attorney, Agent, or Firm*—Lerner, David, Littenberg, Krumholz & Mentlik, LLP

(57) ABSTRACT

A sound localization apparatus capable of localizing a sound image at a given position, in a simple configuration is provided with: a first signal processor for convoluting an input audio signal with a first impulse response corresponding to a path from a reference sound source position to the listener's left ear to generate a left-channel audio signal for localization; a second signal processor for convoluting the input audio signal with a second impulse response corresponding to a path from the reference sound source position to the listener's right ear to generate a right-channel audio signal for localization; and a third signal processor for applying a third impulse response so as to localize a sound image obtained by reproducing the audio signals for localization at a position different from the reference sound source position.

12 Claims, 12 Drawing Sheets

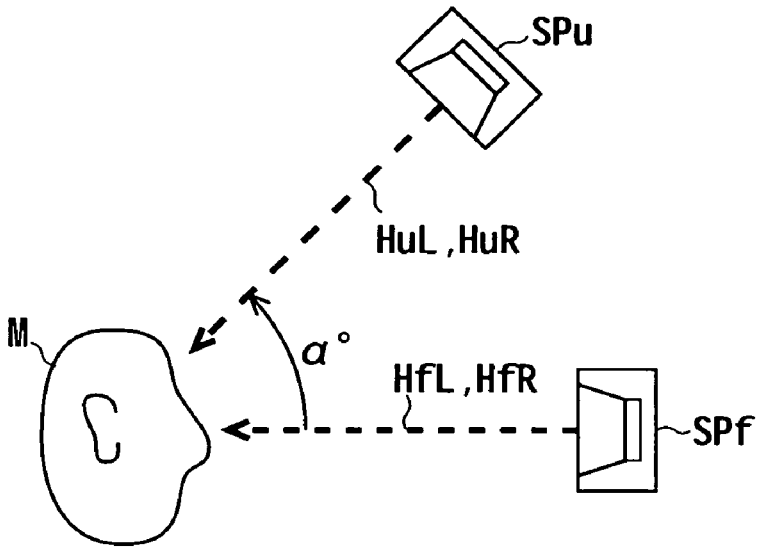
FIG.7
FIG.8A
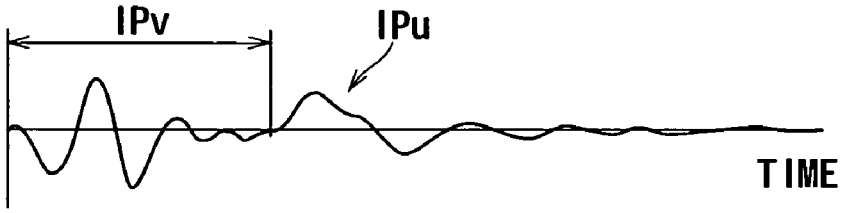
FIG.8B
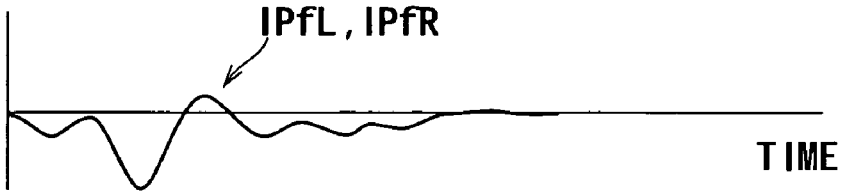
FIG.8C
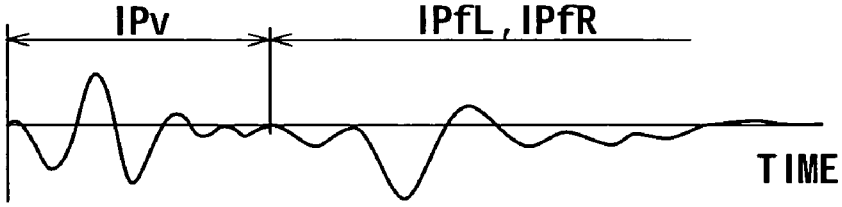

SOUND IMAGE LOCALIZATION APPARATUS

CROSS REFERENCE TO RELATED APPLICATIONS

The present invention contains subject matter related to Japanese Patent Application JP 2004-191952 filed in the Japanese Patent Office on Jun. 29, 2004, the entire contents of which being incorporated herein by reference.

BACKGROUND OF THE INVENTION

1. Field of the Invention

The present invention relates to a sound image localization apparatus and is preferably applied to the case where a sound image reproduced with a headphone, for example, is localized at a given position.

2. Description of the Related Art

When an audio signal is supplied to a speaker and reproduced, a sound image is localized ahead of a listener. On the other hand, when the same audio signal is supplied to a headphone unit and reproduced, a sound image is localized within the listener's head, with the result that an extremely unnatural sound field is created.

In order to realize natural localization of a sound image in a headphone unit, there has been proposed a headphone unit adapted to enable, by measuring or calculating impulse responses from a given speaker position to both ears of a listener and by convoluting and reproducing audio signals with the impulse responses with the use of digital filters or the like, natural localization of a sound image outside the head as if the audio signals were reproduced from a real speaker (see Japanese Patent Laid-Open No. 2000-227350).

FIG. 1 shows the configuration of a headphone unit 100 for localizing a sound image of a one-channel audio signal outside the head. The headphone unit 100 digitally converts an analog audio signal SA of one channel inputted via an input terminal 1 by means of an analog/digital conversion circuit 2 to generate a digital audio signal SD, and supplies it to digital processing circuits 3L and 3R. The digital processing circuits 3L and 3R performs signal processing for localization outside the head, on the digital audio signal SD.

As shown in FIG. 2, when a sound source SP at which the sound image is to be localized is located in front of a listener M, a sound outputted from the sound source SP reaches the left and right ears of the listener M via paths with transfer functions HL and HR. The impulse responses of the left and right channels with the transfer functions HL and HR converted to time axes are measured or calculated in advance.

The digital processing circuits 3L and 3R convolute the digital audio signal SD with the above-described left-channel and right-channel impulse responses, respectively, and outputs the obtained signals as digital audio signals SDL and SDR. The digital processing circuits 3L and 3R are configured by an Finite Impulse Response (FIR) filter as shown in FIG. 3.

Digital/analog conversion circuits 4L and 4R analogously convert the digital audio signals SDL and SDR to generate analog audio signals SAL and SAR, respectively, amplify the analog audio signals with corresponding amplifiers 5L and 5R and supply them to a headphone 6. Acoustic units (electric/acoustic conversion devices) 6L and 6R of the headphone 6 convert the analog audio signals SAL and SAR to sounds, respectively, and output the sounds.

Accordingly, the left and right reproduced sounds outputted from the headphone 6 are equivalent to the sounds which have reached from a sound source SP shown in FIG. 2 via the paths with the transfer functions HL and HR. Thereby, when the listener equipped with the headphone 6 listens to the reproduced sounds, the sound image is localized at the position of the sound source SP shown in FIG. 2 (namely, outside the head).

Description has been made on the case of one sound image. Next, description will be made on the case where multiple sound images are localized at different sound source positions.

Description will be made with the use of FIG. 3 on a headphone unit 101 in the case of localizing a sound image at each of two positions of a forward sound source SPf straight ahead of a listener and an upper sound source SPu $\alpha^{\circ}$ above and ahead of the listener as shown in FIG. 4, for example. Impulse responses of transfer functions HfL and HfR from the forward sound source SPf to both ears of the listener M and transfer functions HuL and HuR from the upper sound source SPu to both ears of the listener M converted to time axes are measured or calculated in advance.

In FIG. 5, an analog/digital conversion circuit 2*f* of the headphone unit 101 digitally converts an analog audio signal SAf for front localization inputted via an input terminal 1*f* to generate a digital audio signal SDf, and supplies it to subsequent-stage digital processing circuits 3*f*L and 3*f*R. Similarly, an analog/digital conversion circuit 2*u* digitally converts an analog audio signal SAu for upper localization inputted via an input terminal 1*u* to generate a digital audio signal SDu, and supplies it to subsequent-stage digital processing circuits 3*u*L and 3*u*R.

The digital processing circuits 3*f*L and 3*u*L convolute digital audio signals SDf and SDu with impulse responses to the left ear, respectively, and supply the digital audio signals to an addition circuit 7L as digital audio signals SDfL and SDuL. Similarly, the digital processing circuits 3*f*R and 3*u*R convolute digital audio signals SDf and SDu with impulse responses to the right ear, respectively, and supply the signals to the addition circuit 7R as digital audio signals SDfR and SDuR. Each of the digital processing circuits 3*f*L, 3*f*R, 3*u*L and 3*u*R is configured by the FIR filter shown in FIG. 3.

The addition circuit 7L adds the digital audio signals SDfL and SDuL convoluted with the impulse responses, to generate a left-channel digital audio signal SDL. Similarly, the addition circuit 7R adds the digital audio signals SDfR and SDuR convoluted with the impulse responses, to generate a right-channel digital audio signal SDR.

The digital/analog conversion circuits 4L and 4R analogously convert the digital audio signals SDL and SDR to generate analog audio signals SAL and SAR, respectively, amplify the analog audio signals with the corresponding amplifiers 5L and 5R and supply them to the headphone 6. The acoustic units 6L and 6R of the headphone 6 convert the analog audio signals SAL and SAR to sounds, respectively, and output the sounds.

Left and right reproduced sounds outputted from the headphone 6 are equivalent to sounds which have reached from the forward sound source SPf shown in FIG. 4 via the paths with the transfer functions HfL and HfR, and equivalent to sounds which have reached from the upper sound source SPu via the paths with the transfer functions HuL and HuR, respectively. Thereby, when the listener equipped with the headphone 6 listens to the reproduced sounds, sound images are localized at the positions of the forward sound source SPf and the upper sound source SPu.

SUMMARY OF THE INVENTION

As described above, it is possible to realize a headphone unit which localizes a sound image at a given position by reproducing a pair of transfer functions reaching both ears of a listener from a sound source by means of digital signal processing. However, there is a problem that, as the number of sound sources to be localized is increased, the amount of digital signal processing is also increased accordingly, and thereby the configuration of the entire headphone unit is complicated.

Furthermore, in order to realize such sound image localization that a sound source moves from the position of the forward sound source SPf to the position of the upper sound source SPu in FIG. 4, it may be necessary to sequentially change the impulse responses for convolution in the digital processing circuits 3L and 3R, from those of the transfer functions HfL and HfR straight ahead to those of the transfer functions HuL and HuR above and ahead, in the headphone unit 100 shown in FIG. 1. Specifically, there is a problem that, since all the coefficients k1 to kn of the number corresponding to the order n of the FIR filter shown in FIG. 3 should be updated at the same time, and this may require a long processing time and a large amount of memory for storing the coefficients, the configuration of the entire headphone unit is complicated.

The present invention has been made in consideration of the above problem, and intends to propose a sound image localization apparatus capable of localizing a sound image at a given position in a simple configuration.

In order to solve the problem, according to an embodiment of the invention, there is provided a sound image localization apparatus including: a first signal processing means for convoluting an input audio signal with a first impulse response corresponding to a path from a reference sound source position to a listener's left ear to generate a first audio signal for localization; a second signal processing means for convoluting the input audio signal with a second impulse response corresponding to a path from the reference sound source position to a listener's right ear to generate a second audio signal for localization; and a third signal processing means for applying a third impulse response, other than the first and second impulse responses, so as to localize a sound image obtained by reproducing the first and second audio signals for localization at a position different from the reference sound source position.

By applying the third impulse, in addition to the first and second impulse responses which localize a sound image, the sound image can be moved from the sound source position localized by the first and second impulse responses. By convoluting these impulse responses in an appropriate combination, it is possible to localize a sound image at a given position in a simple configuration.

Further, according to an embodiment of the present invention, there provided is a sound image localization method comprising a localization position changing step of convoluting an input audio signal with a first impulse response corresponding to a path from a reference sound source position to a listener's left ear, a second impulse response corresponding to a path to a listener's right ear, and a third impulse response, so as to localize a reproduced sound image at a position different from the reference sound source position.

By applying the third impulse response, other than the first and second impulse responses which localize a sound image, it is possible to move a sound image from a sound source position localized by the first and second impulse responses. And, by convoluting these impulse responses in an appropriate combination, it is possible to localize a voice image at a given position in a simple configuration.

Still further, according to an embodiment of the present invention, there provided is a storage medium storing a sound image localization program for causing an information processor to localize a sound image. The sound image localization program comprises a localization position changing step of convoluting an input audio signal with a first impulse response corresponding to a path from a reference sound source position to a listener's left ear, a second impulse response corresponding to a path to a listener's right ear, and a third impulse response, so as to localize a reproduced sound image at a position different from a reference sound source position.

By applying the third impulse response, other than the first and second impulse responses which localize a sound image, the sound image can be moved from the sound source position localized by the first and second impulse responses. By convoluting these impulse responses in an appropriate combination, it is possible to localize a sound image at a given position in a simple configuration.

According to the present invention, by adding a third impulse response to first and second impulse responses which localize a sound image, the sound image can be moved from the sound source position localized by the first and second impulse responses. By convoluting these impulse responses in an appropriate combination, a sound image localization apparatus can be realized which is capable of localizing a sound image at a given position in a simple configuration.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 7 is a schematic diagram to illustrate localization of a sound image in the first embodiment;

FIGS. 8A to 8C are characteristic curve diagrams to illustrate an impulse response;

DETAILED DESCRIPTION OF THE PREFERRED EMBODIMENTS

Embodiments of the present invention will be described below with reference to drawings.

(1) First Embodiment

Figure 1:
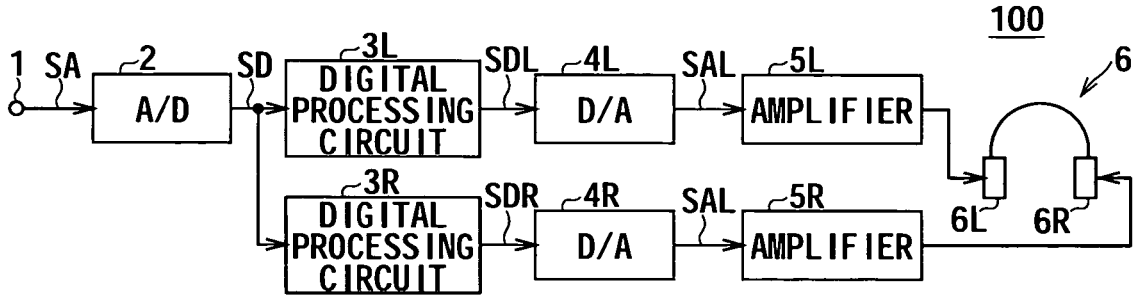
FIG.1 (Related Art)
FIG. 1 is a block diagram showing the entire configuration of a headphone unit in related art.
Figure 2:
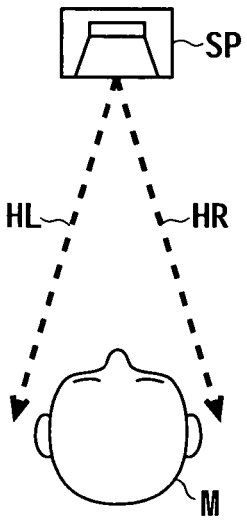
FIG.2 (Related Art)
FIG. 2 is a schematic diagram to illustrate localization of a sound image in a headphone unit.
Figure 3:
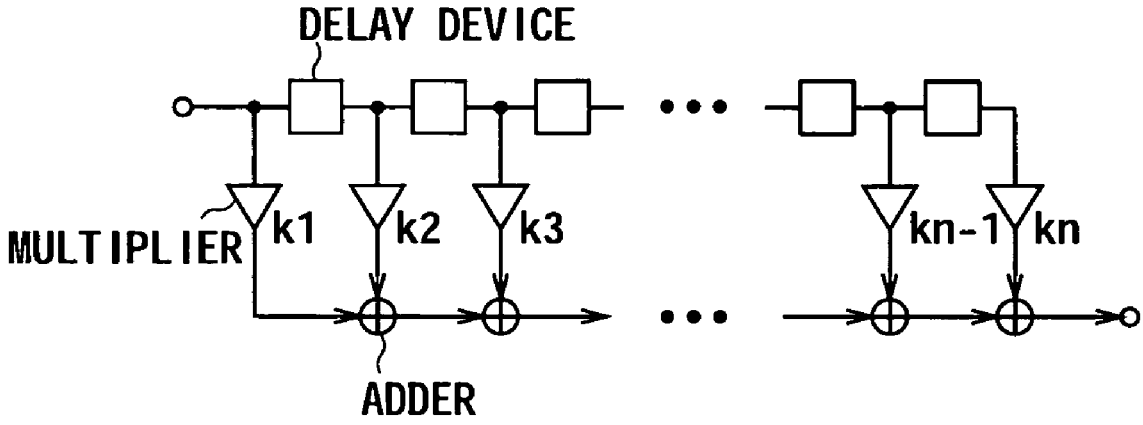
FIG.3 (Related Art)
FIG. 3 is a block diagram showing the configuration of an FIR filter.
Figure 4:
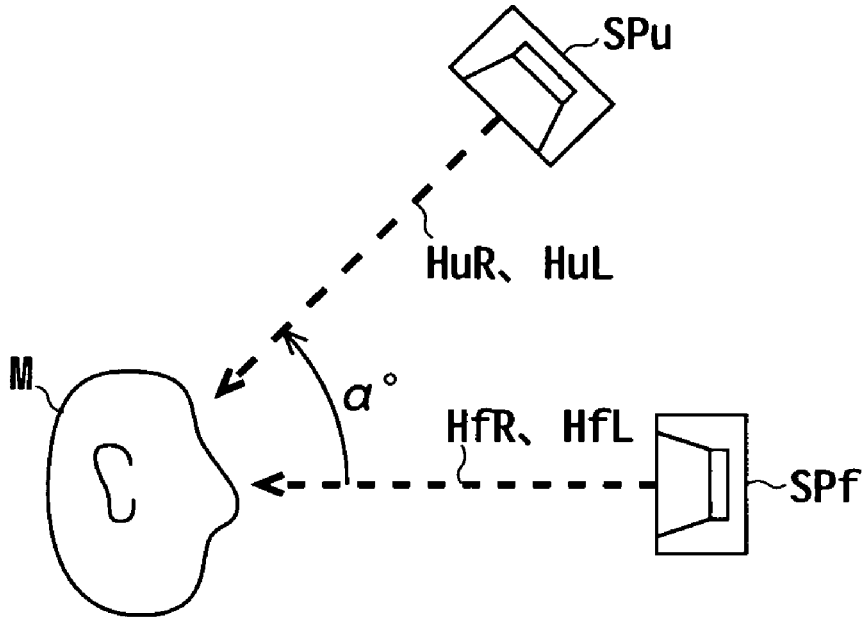
FIG.4 (Related Art)
FIG. 4 is a schematic diagram to illustrate transfer functions in the case of multiple sound sources.
Figure 5:
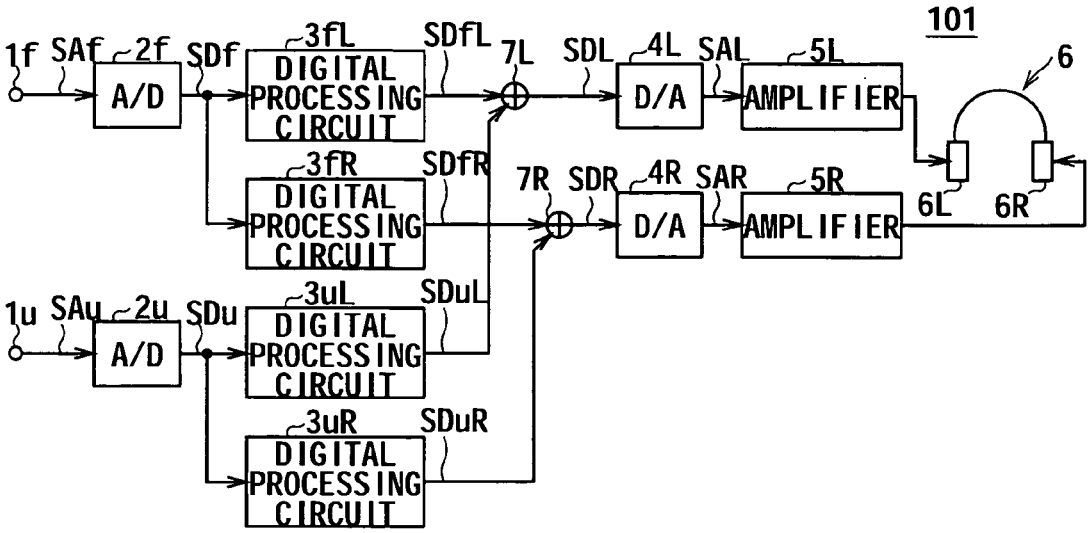
FIG.5 (Related Art)
FIG. 5 is a block diagram showing the configuration of a two-channel enabled headphone unit.
Figure 6:
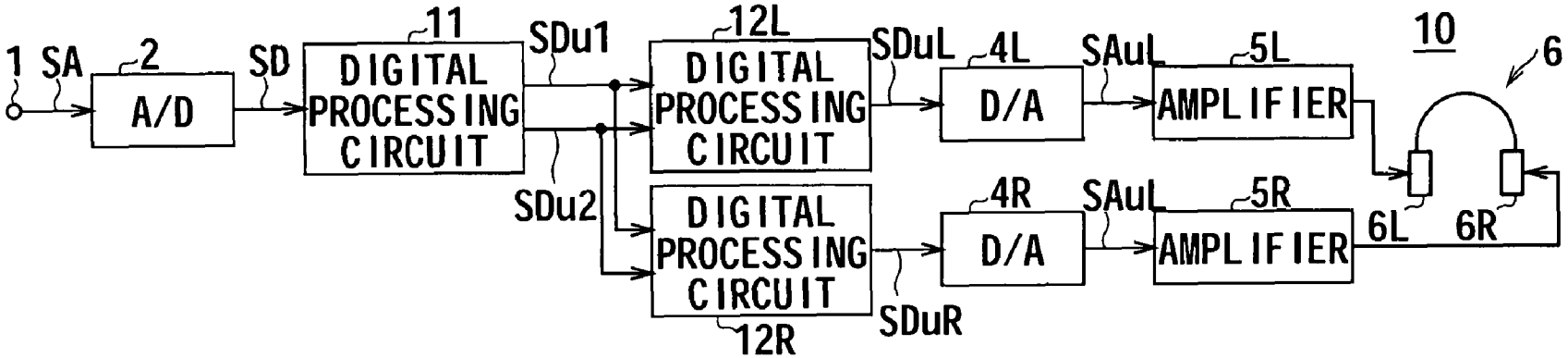
FIG. 6 is a block diagram showing the entire configuration of a headphone unit of a first embodiment.

In FIG. 6, in which sections common to FIG. 1 and FIG. 5 are given the same reference numerals, reference numeral 10 denotes a headphone unit of a first embodiment of the present invention, which is adapted to localize an inputted audio signal SA of one channel outside the head, at the position of an upper sound source SPu $\alpha°$ above and ahead of the listener as shown in FIG. 7.

In this case, a human being recognizes the horizontal direction of a sound source based on level difference or phase difference of sounds reaching his left and right ears, and additionally, he also recognizes the vertical direction of the sound source. The applicant of this specification has found that the top portions of impulse responses of transfer functions from a sound source to the ears converted to time axes are deeply involved in the recognition of the vertical direction.

FIG. 8A shows the impulse response IPu of the transfer functions HuL and HuR from the upper sound source SPu to both ears of the listener M converted to time axes, and the top portion of the impulse response IPu is an impulse response IPv which forms localization of the vertical direction of the sound image. The impulse responses to both ears are assumed to be the same because the upper sound source SPu is located ahead of the listener M.

The headphone unit 10 utilizes this, and localizes a sound image at a given upper, lower, left or right position by performing sound image localization processing with the use of first and second impulse responses which form horizontal-direction localization (to be described later) as well as the third impulse response IPv which form vertical direction of a sound image. Accordingly, the headphone unit 10 has a third digital processing circuit 11 for performing vertical-direction localization of a sound image with the use of the third impulse response IPv in addition to a first digital processing circuit 12L and a second digital processing circuit 12R for performing horizontal-direction localization of a sound image.

In FIG. 6, the headphone unit 10 as a sound image localization apparatus digitally converts an analog audio signal SA inputted via an input terminal 1, by means of an analog digital conversion circuit 2 to generate a digital audio signal SD, and supplies it to the third digital processing circuit 11, which the present invention is characterized in.

Figure 9:
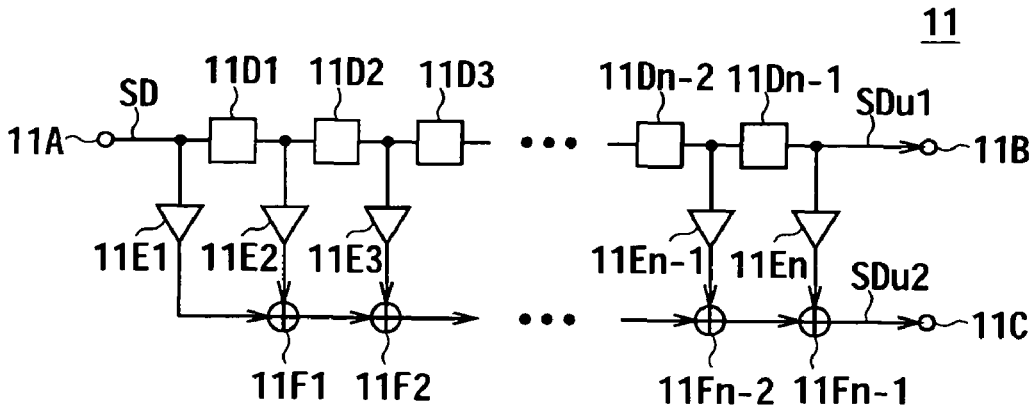
FIG. 9 is a block diagram showing the configuration of a first digital signal processing circuit.

FIG. 9 shows the configuration of the third digital processing circuit 11, which is an n-tap FIR filter configured by n-1 delay devices 11D1 to 11Dn-1, n multipliers 11E1 to 11En, and n-1 adders 11F1 to 11Fn.

The third digital processing circuit 11 convolutes the digital audio signal SD inputted via an input terminal 11A with an impulse response IPv which forms vertical-direction localization, supplies a digital audio signal SDu1 outputted from the final-stage delay device 11Dn-1 to the first digital processing circuit 12L and the second digital processing circuit 12R (FIG. 6) via a first output terminal 11B, and supplies a digital audio signal SDu2 outputted from the final-stage adder 11Fn-1 to the first digital processing circuit 12L and the second digital processing circuit 12R via a second output terminal 11C.

Figure 10:
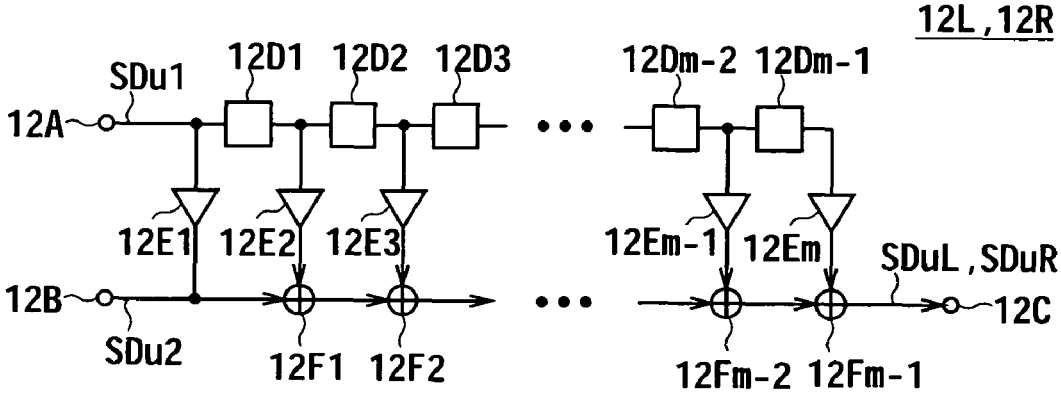
FIG. 10 is a block diagram showing the configuration of second and third digital signal processing circuits.

The first digital processing circuit 12L and the second digital processing circuit 12R are in the same configuration. FIG. 10 shows the configuration of the first digital processing circuit 12L and the second digital processing circuit 12R, which is an m-tap FIR filter configured by m-1 delay devices 12D1 to 12Dm-1, m multipliers 12F1 to 12Em, and m-1 adders 12F1 to 12Fm-1.

The first digital processing circuit 12L convolutes the digital audio signal SDu1 inputted via an input terminal 12A and the digital audio signal SDu2 inputted via an input terminal 12B, with an impulse response of the transfer function HfL from the forward sound source SPf straight ahead of the listener M shown in FIG. 7 to the left ear of the listener M converted to a time axis, and supplies a left-channel digital audio signal SDuL outputted from the final-stage adder 12Fn-1 to a digital/analog conversion circuit 4L via an output terminal 12C.

Similarly, the second digital processing circuit 12R convolutes the digital audio signal SDu1 inputted via the input terminal 12A and the digital audio signal SDu2 inputted via the input terminal 12B with an impulse response of the transfer function HfR from the forward sound source SPf straight ahead of the listener M shown in FIG. 7 to the right ear of the listener M converted to a time axis, and supplies a right-channel digital audio signal SDuR outputted from the final-stage adder 12Fn-1 to a digital/analog conversion circuit 4R via the output terminal 12C.

The digital/analog conversion circuits 4L and 4R analogously convert the digital audio signals SDuL and SDuR to generate analog audio signals SAuL and SAuR, respectively, amplify the analog audio signals by subsequent-stage amplifiers 5L and 5R, and supply them to a headphone 6. Acoustic units 6L and 6R of the headphone 6 convert the analog audio signals SAuL and SAuR to sounds, respectively, and output the sounds.

In this case, as described above, the headphone unit 10 performs the convolution with the impulse response IPv which forms vertical-direction localization (FIG. 8A) by means of the third digital processing circuit 11 first, and then performs convolution with the impulse responses IPfL and IPfR which form horizontal-direction localization (FIG. 8B) by means of the first and second digital processing circuits 12L and 12R.

Thereby, the headphone unit 10 as a whole, as shown in FIG. 8C, performs convolution with a sequence of impulse responses in which the impulse response IPv which forms vertical-direction localization is added to the top of the impulse responses IPfL and IPfR which form horizontal-direction localization.

Accordingly, a sound image is localized by left and right reproduced sounds outputted from the headphone 6 at the position of the upper sound source SPu which is above the forward sound source SPf located straight ahead and localized by the impulse responses IPfL and IPfR, as a reference sound source position, by $\alpha°$ localized by the impulse response IPv.

Convolution of the impulse response IPv which forms vertical-direction localization can be realized by a small-scaled n-tap FIR filter, where n=10 to 20.

By storing multiple impulse responses which form vertical-direction localization and multiple impulse responses which form horizontal-direction localization and convoluting them in appropriate combination, a sound image can be localized at a given upper, lower, left or right position.

According to the above configuration, an audio signal to be processed for sound image localization is convoluted with an impulse response which forms vertical-direction localization, and then is convoluted with an impulse response which forms horizontal-direction localization, and thereby, it is possible to realize a headphone unit capable of localizing a sound image at a given upper, lower, left or right position, in a simple configuration.

(2) Second Embodiment

Figure 11:
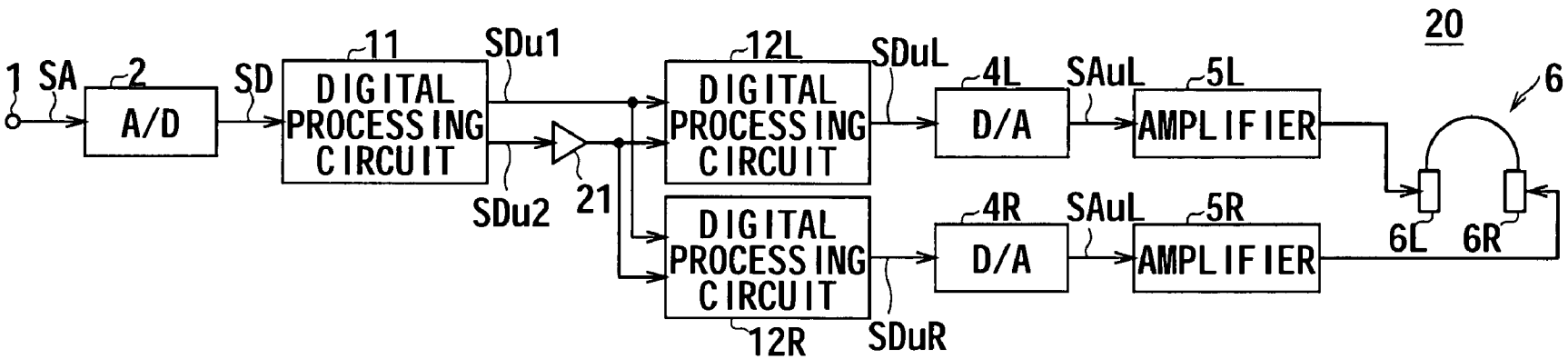
FIG. 11 is a block diagram showing the entire configuration of a headphone unit of a second embodiment.

In FIG. 11, in which sections common to FIG. 6 are given the same reference numerals, reference numeral 20 denotes a headphone unit of a second embodiment of the present invention, which is the same as the headphone unit 10 of the first embodiment except that an attenuator 21 is inserted between the second output terminal 11*c* (FIG. 9) of the third digital processing circuit 11 and the first and second digital processing circuits 12L and 12R.

The amount of attenuation of the attenuator 21 can be set to any value from 0 to infinity. First, when the amount of attenuation of the attenuator 21 is set to 0, the vertical-direction impulse response IPv to be used for convolution in the third digital processing circuit 11 is immediately reflected on localization of a sound image, so that the sound image is localized at the position of the upper sound source SPu (FIG. 7) similarly to the first embodiment.

As the amount of attenuation of the attenuator 21 is increased from this condition, the influence of the vertical-direction impulse response IPv is decreased accordingly, and therefore, the sound image descends from the upper sound source SPu toward the forward sound source SPf. When the amount of attenuation of the attenuator 21 becomes infinity, the influence of the impulse response IPv disappears, and the sound image is located at the forward sound source SPf then.

Thus, by controlling the influence of the impulse response IPv which forms vertical-direction localization by means of the attenuator 21, it is possible to localize a sound image at any vertical position, where the maximum position is the position localized by the impulse response IPv. By convoluting such impulse response IPv in combination with an impulse response which forms horizontal-direction localization, it is possible to localize a sound image at a given upper, lower, left or right position.

According to the above configuration, the attenuator 21 for attenuating the influence of the impulse response IPv is provided at the subsequent stage of the third digital processing circuit 11 for performing convolution with the impulse response IPv which forms vertical-direction localization, and thereby, it is possible to realize a headphone unit capable of localizing a sound image at a given upper, lower, left or right position, in a simpler configuration.

(3) Third Embodiment

Figure 12:
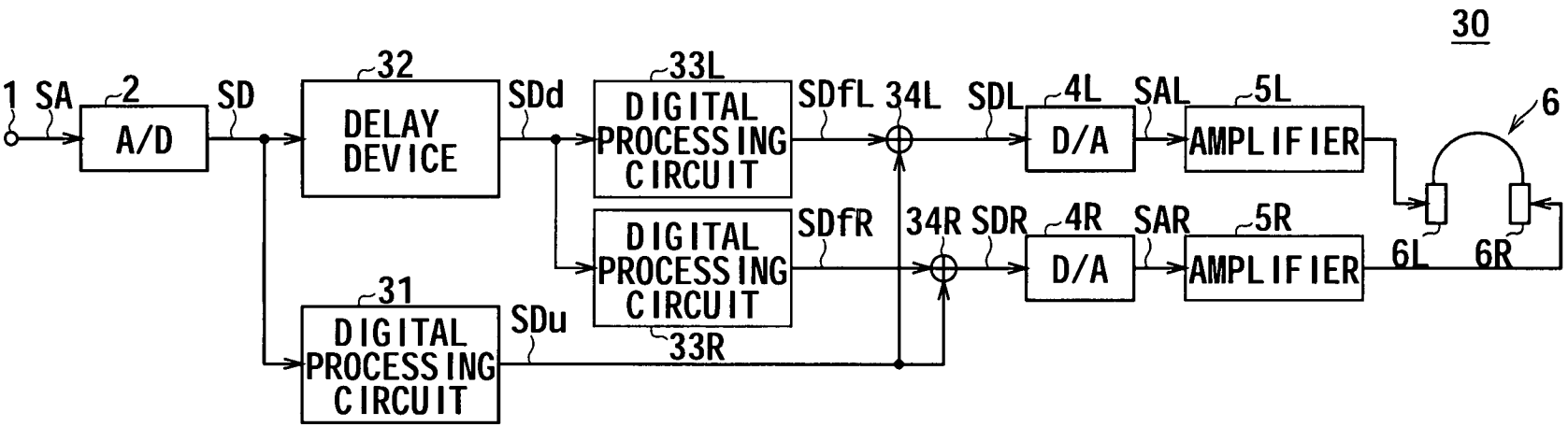
FIG. 12 is a block diagram showing the entire configuration of a headphone unit of a third embodiment.

In FIG. 12, in which sections common to FIG. 6 and FIG. 11 are given the same reference numerals, reference numeral 30 denotes a headphone unit of a third embodiment of the present invention, which is different from the headphone units of the above-described first and second embodiments in that a third digital processing circuit 31 for performing convolution with an impulse response which forms vertical-direction localization and first and second digital processing circuits 33L and 33R for performing convolution with an impulse response which forms horizontal-direction localization perform processing in parallel.

The headphone unit 30 as a sound image localization apparatus digitally converts an analog audio signal SA inputted via the input terminal 1 by means of the analog digital conversion circuit 2 to generate a digital audio signal SD, and supplies it to the third digital processing circuit 31 and a delay device 32.

Figure 13:
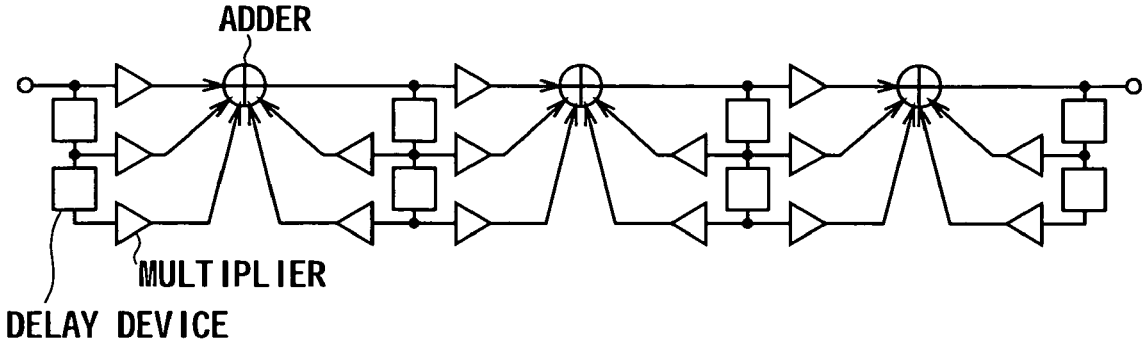
FIG. 13 is a block diagram showing the configuration of an IIR filter.
Figure 14:
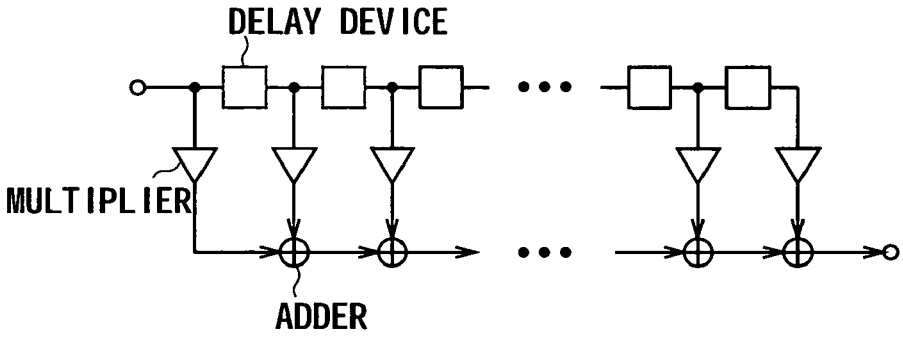
FIG. 14 is a block diagram showing the configuration of an FIR filter.

The third digital processing circuit 31 convolutes the digital audio signal SD with an impulse response IPv (FIG. 8B) which forms vertical-direction localization, and supplies it to adders 34L and 34R as a digital audio signal SDu. An IIR (Infinite Impulse Response) filter as shown in FIG. 13 or an FIR filter as shown in FIG. 14 is used as the third digital processing circuit 31.

Meanwhile, the delay device 32 provides the digital audio signal SD with delay corresponding to the impulse response IPv at the third digital processing circuit 31, and supplies the digital audio signal to the first and second digital processing circuits 33L and 33R. The first and second digital processing circuits 33L and 33R are in the same configuration, and FIR filters as shown in FIG. 14 are used therefor.

The first digital processing circuit 12L convolutes the digital audio signal SD with an impulse response IPfL (FIG. 8B) of the transfer function HfL from the forward sound source SPf straight ahead of the listener M shown in FIG. 7 to the left ear of the listener M converted to a time axis, and supplies it to the adder 34L as a digital audio signal SDfL. Similarly, the second digital processing circuit 12R convolutes the digital audio signal SD with an impulse response IPfR of the transfer function HfR from the forward sound source SPf straight ahead of the listener M shown in FIG. 7 to the right ear of the listener M converted to a time axis, and supplies it to the adder 34R as a digital audio signal SDfR.

The adder 34L synthesizes the digital audio signal SDu and the digital audio signal SDfL to output a left-channel digital audio signal SDuL. Similarly, the adder 34R synthesizes the digital audio signal SDu and the digital audio signal SDfL to output a left-channel digital audio signal SDuR.

The digital/analog conversion circuits 4L and 4R convert the digital audio signals SDuL and SDuR to generate analog audio signals SAuL and SAuR, respectively, amplify the analog audio signals by means of the subsequent-stage amplifiers 5L and 5R, and supplies them to the headphone 6. Acoustic units 6L and 6R of the headphone 6 convert the analog audio signals SAuL and SAuR to sounds, respectively, and output them.

In this case, as described above, the digital audio signals SD inputted into the first and second digital processing circuits 33L and 33R are delayed by the adder 32 by the time corresponding to the impulse response IPv. Therefore, the digital audio signals SDfL and SDfR outputted from the first and second digital processing circuits 33L and 33R, for which vertical-direction localization has been performed, are also delayed by the time corresponding to the impulse response IPv relative to the digital audio signal SDu, for which vertical-direction localization has been performed.

Accordingly, for the digital audio signals SDuL and SDuR which have been synthesized by the adders 34L and 34R, processing has been performed which is equivalent to that for the sequence of impulses in which the impulse response IPv forming vertical-direction localization is added to the top of the impulse responses IPfL and IPfR forming horizontal-direction localization as shown in FIG. 8C.

Accordingly, a sound image is localized by left and right reproduced sounds outputted from the headphone 6 at the position of the upper sound source SPu which is above the forward sound source SPf (FIG. 7) located straight ahead and localized by the impulse responses IPfL and IPfR, by $\alpha^{\circ}$ localized by the impulse response IPv.

By storing multiple impulse responses which form vertical-direction localization and multiple impulse responses which form horizontal-direction localization and convoluting them in appropriate combination, an sound image can be localized at a given upper, lower, left or right position.

Furthermore, since an IIR filter, the configuration of which is simpler than that of an FIR filter, can be used as the third digital processing circuit 31, the entire configuration of the headphone unit 30 can be further simplified in comparison with the headphone units 10 and 20 of the first and second embodiments described above.

According to the above configuration, vertical-direction localization is performed for an audio signal to be processed, the sound image of which is to be localized; horizontal-direction localization is performed for the audio signal to be processed after the audio signal is delayed by the amount corresponding to the impulse response which forms the vertical-direction localization; and then the obtained signals are synthesized. Thereby, it is possible to realize a headphone unit capable of localizing a sound image at a given upper, lower, left or right position in a simple configuration.

(4) Fourth Embodiment

Figure 15:
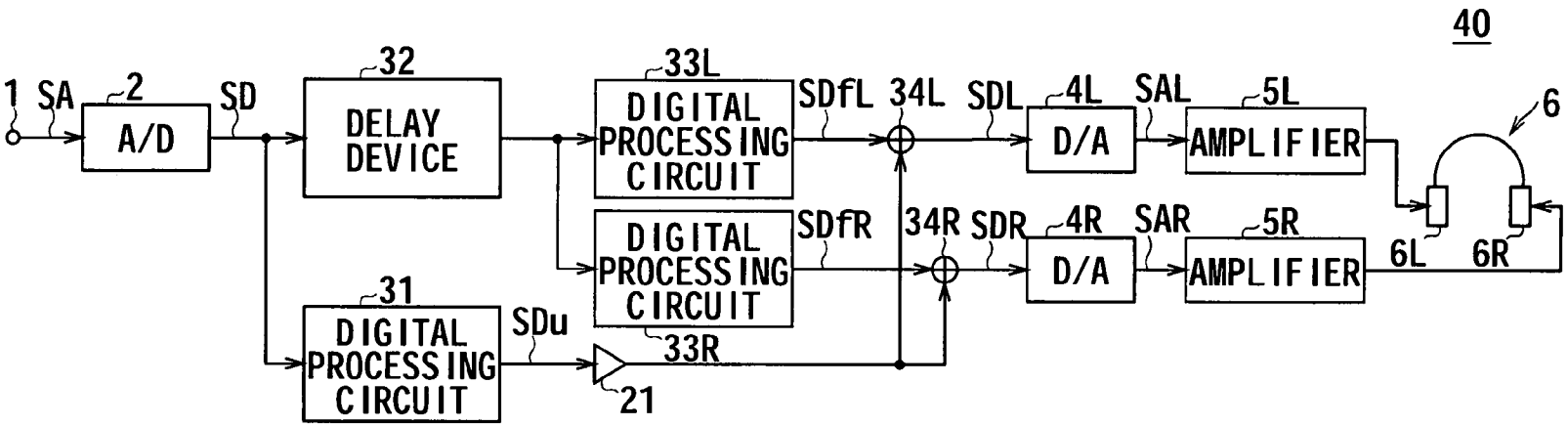
FIG. 15 is a block diagram showing the entire configuration of a headphone unit of a fourth embodiment.

In FIG. 15, in which sections common to FIG. 12 are given the same reference numerals, reference numeral 40 denotes a headphone unit of a fourth embodiment of the present invention, which is the same as the headphone unit 30 of the third embodiment except that an attenuator 21 is inserted between the third digital processing circuit 31 and the adders 34L and 34R.

The amount of attenuation of the attenuator 21 can be set to any value from 0 to infinity. First, when the amount of attenuation of the attenuator 21 is set to 0, the vertical-direction impulse response IPv to be used for convolution in the third digital processing circuit 31 is immediately reflected on localization of a sound image, so that the sound image is localized at the position of the upper sound source SPu (FIG. 7).

As the amount of attenuation of the attenuator 21 is increased, the influence of the vertical-direction impulse response IPv is decreased accordingly, and therefore, the sound image moves from the upper sound source SPu toward the forward sound source SPf. When the amount of attenuation of the attenuator 21 becomes infinity, the influence of the impulse response IPv disappears, and the sound image is located at the forward sound source SPf then.

Thus, by controlling the influence of the impulse response IPv which forms vertical-direction localization by means of the attenuator 21, it is possible to localize a sound image at a given vertical position only by storing the one impulse response IPv. By convoluting this in combination with an impulse response which forms horizontal-direction localization, it is possible to localize a sound image at a given upper, lower, left or right position.

According to the above configuration, the attenuator 21 for attenuating the influence of the impulse response IPv is provided at the subsequent stage of the third digital processing circuit 31 for performing convolution with the impulse response IPv which forms vertical-direction localization, and thereby it is possible to realize a headphone unit capable of localizing a sound image at a given upper, lower, left or right position, in a simpler configuration.

(5) Other Embodiments

Though, description has been made on a case where the present invention is applied to a headphone unit for localizing a sound image outside the head in the above first to fourth embodiments, the present invention is not limited thereto. The present invention can be applied to a speaker unit for localizing a sound image at a given position.

Furthermore, though a sound image is localized at a given vertical position, where the maximum position is the position localized by the impulse response IPv, by providing the attenuator 21 for attenuating the influence of the impulse response IPv at the subsequent stage of the third digital processing circuits 11 and 31 for performing convolution with the impulse response IPv which forms vertical-direction localization, in the second and fourth embodiments described above, the present invention is not limited thereto. An amplifier for increasing the influence of impulse response IPv may be provided at the subsequent stage of the third digital processing circuits 11 and 31 instead of the attenuator 21. In this case, as the amplification rate of the amplifier is increased, a sound image moves upward or downward from the position localized by the impulse response IPv accordingly.

Furthermore, though the third digital processing circuits 11 and 31 perform convolution with the impulse response IPv which forms vertical-direction localization in the first to fourth embodiments described above, the present invention is not limited thereto. The third digital processing circuits 11 and 31 may perform convolution with an impulse response which forms horizontal-direction localization.

Furthermore, though a sequence of signal processings for convoluting an audio signal with an impulse response is executed by hardware such as a digital processing circuit, in the first to fourth embodiments described above, the present invention is not limited thereto. The sequence of signal processings may be performed by a signal processing program to be executed on information processing means such as a Digital Signal Processor (DSP).

Figure 16:
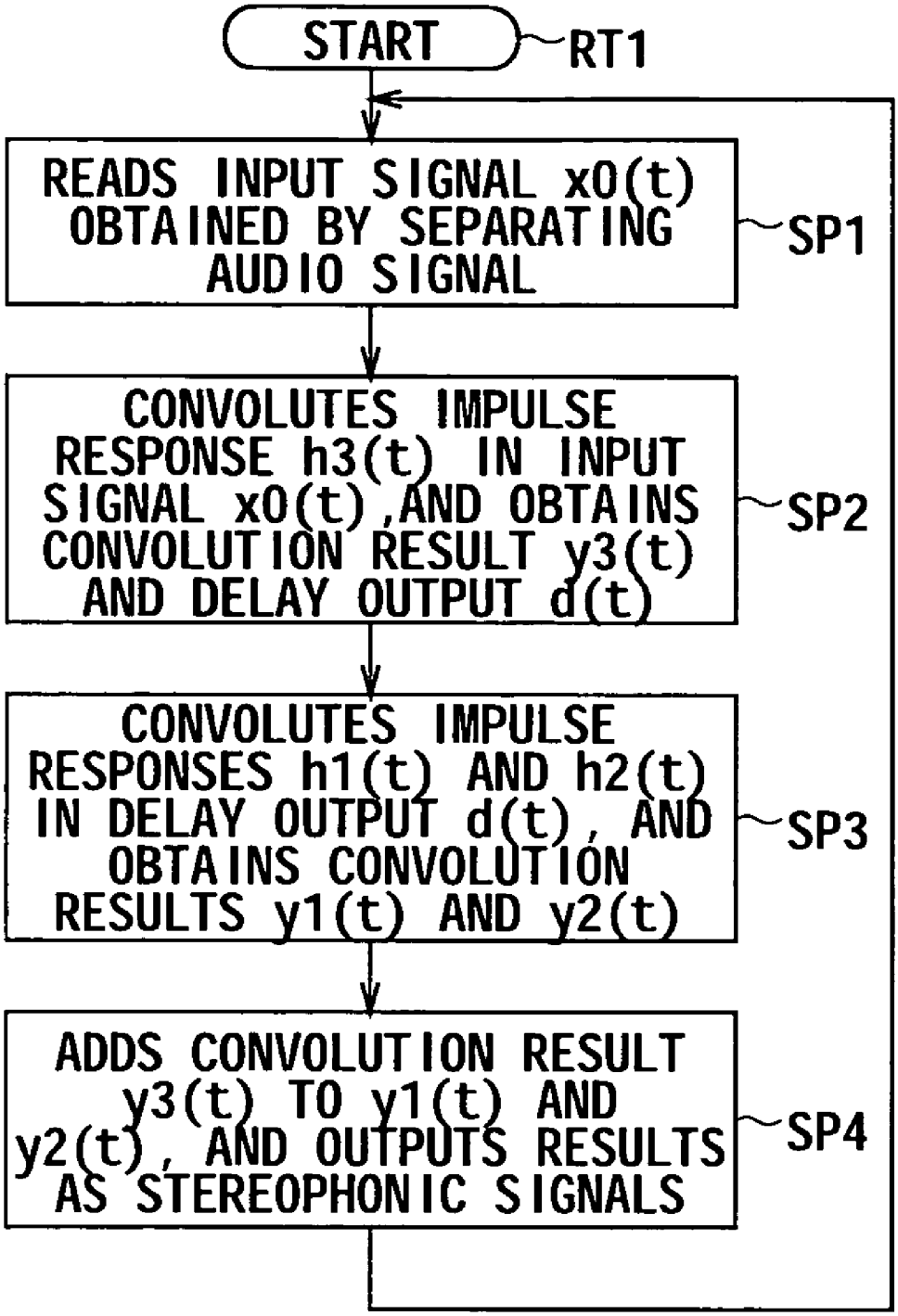
FIG. 16 is a flowchart of a sound field localization processing procedure corresponding to the first embodiment.

First, a sound image localization processing program for performing signal processing corresponding to that of the headphone unit 10 of the first embodiment will be described with the use of a flowchart shown in FIG. 16. The headphone-unit information processing means starts from a start step of a sound image localization processing procedure routine RT1 and proceeds to step SP1, where it reads an input signal $x_0(t)$, obtained by separating a digital audio signal SD by predetermined time intervals. Then, the information processing means proceeds to the next step SP2.

At step SP2, the headphone-unit information processing means convolutes the input signal $x_0(t)$ with an impulse response $h_3(t)$ which forms vertical-direction localization, obtains the convolution result $y_3(t)$ and a delay output d(t), and proceeds to the next step SP3. The convolution result $y_3(t)$ is equivalent to the digital audio signal SDu2 outputted from the final-stage adder 11Fn-1 shown in FIG. 9, and the delay output d(t) is equivalent to the digital audio signal SDu1 outputted from the final-stage delay device 11Dn-1.

At step SP3, the headphone-unit information processing means convolutes the delay output d(t) with impulse responses $h_1(t)$ and $h_2(t)$ which form horizontal localization, obtains the convolution results $y_1(t)$ and $y_2(t)$, and proceeds to the next step SP4.

At step SP4, the headphone-unit information processing means adds the convolution results $y_1(t)$ and $y_2(t)$ to the convolution result $y_3(t)$, outputs the results as stereophonic output signals $z_1(t)$ and $z_2(t)$, and returns to step SP1.

Figure 17:
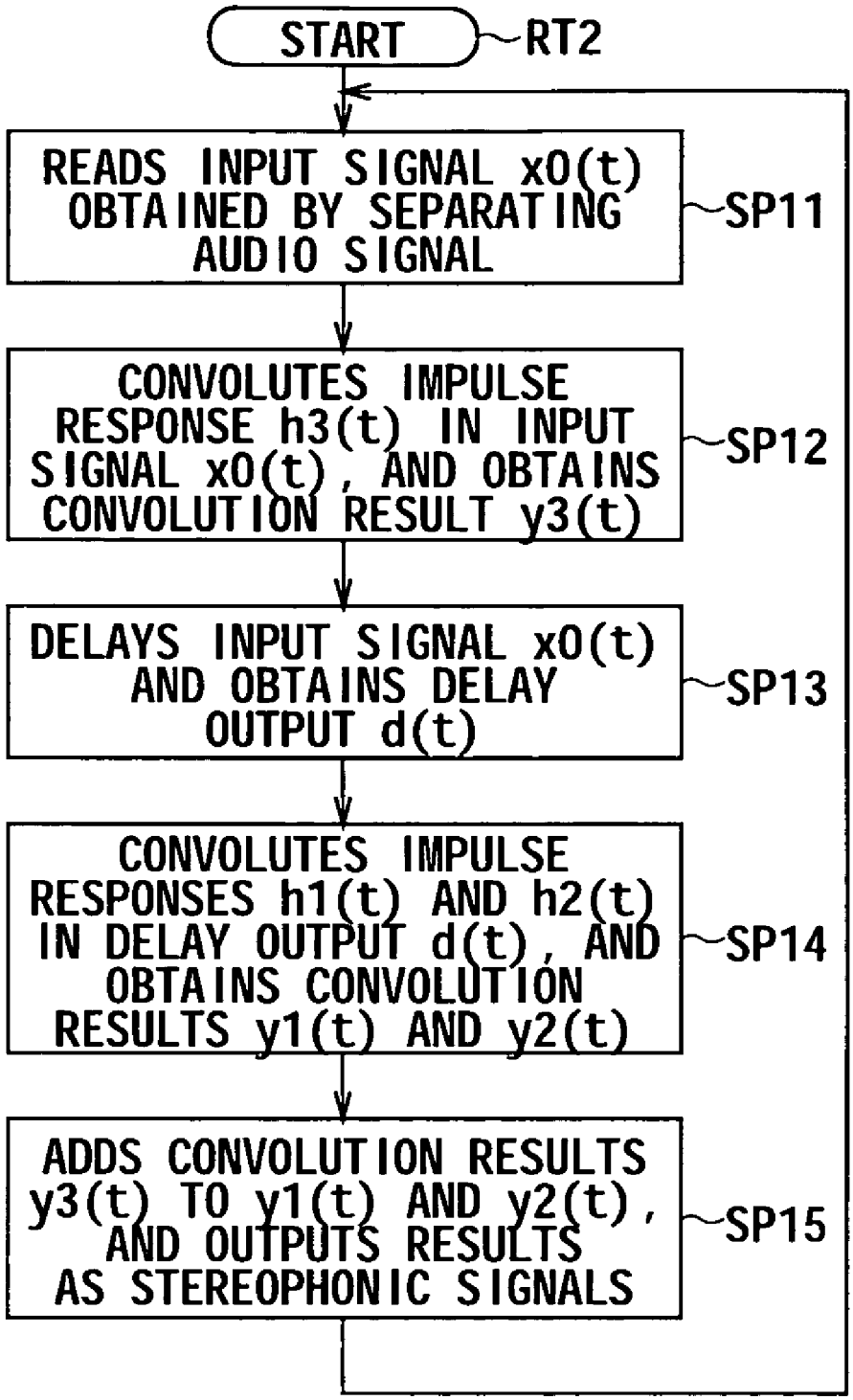
FIG. 17 is a flowchart of a sound field localization processing procedure corresponding to the third embodiment.

Next, a sound image localization processing program for performing signal processing corresponding to that of the headphone unit 30 will be described with the use of a flowchart shown in FIG. 17. The headphone-unit information processing means starts from a start step of a sound image localization processing procedure routine RT2 and proceeds to step SP11, where it reads an input signal $x_0(t)$, obtained by separating a digital audio signal SD by predetermined time intervals. Then, the information processing means proceeds to the next step SP12.

Ag step SP12, the headphone-unit information processing means convolutes the input signal $x_0(t)$ with an impulse response $h_3(t)$, obtains the convolution result $y_3(t)$, and proceeds to the next step SP13. The convolution result $y_3(t)$ is equivalent to the digital audio signal SDu outputted from the third digital processing circuit 31.

At step SP13, the headphone-unit information processing means provides the input signal $x_0(t)$ with delay corresponding to the impulse response $h_3(t)$ to obtain a delay output d(t), and proceeds to step SP14.

At step SP14, the headphone-unit information processing means convolutes the delay output d(t) with the impulse responses $h_1(t)$ and $h_2(t)$ which form horizontal-direction localization, obtains the convolution results $y_1(t)$ and $y_2(t)$, and proceeds to the next step SP15. The convolution results $y_1(t)$ and $y_2(t)$ are equivalent to the digital audio signals SDfL and SDfR outputted from the first and second digital processing circuits 33L and 33R shown in FIG. 12.

At step SP15, the headphone-unit information processing means adds the convolution results $y_1(t)$ and $y_2(t)$ to the convolution result $y_3(t)$, and outputs the results as stereophonic output signals $z_1(t)$ and $Z_2(t)$, and returns to step SP11.

In this way, even in the case of performing sound image localization processing by means of a program, it is possible to reduce processing load of the sound image localization processing by separately performing convolution with an impulse response which forms vertical-direction localization and with an impulse response which forms horizontal-direction localization.

The present invention can be applied for the purpose of localizing a sound image of an audio signal at a given position.

It should be understood by those skilled in the art that various modifications, combinations, sub-combinations and alterations may occur depending on design requirements and other factors insofar as they are within the scope of the appended claims or the equivalents thereof.

What is claimed is:

1. A sound image localization apparatus, comprising:

first signal processing means for convoluting an input audio signal with a first impulse response corresponding to a path from a reference sound source position to a listener's left ear to generate a first audio signal for localization;

second signal processing means for convoluting the input audio signal with a second impulse response corresponding to a path from the reference sound source position to the listener's right ear to generate a second audio signal for localization; and third signal processing means for applying a third impulse response, other than the first and second impulse responses, so as to localize a sound image obtained by reproducing the first and second audio signals for localization at a position different from the reference sound source position, the third signal processing means is operable to convolute the input audio signal with the third impulse response and output an audio signal, the first and second signal processing means are operable to convolute the audio signal output from the third signal processing means with the first and second impulse responses, respectively, to generate the first and second audio signals for localization, and the first impulse response and the second impulse response form horizontal-direction localization and the third impulse response forms vertical-direction localization such that the first signal processing means and the second signal processing means perform horizontal-direction localization of the sound image and the third signal processing means performs vertical-direction localization of the sound image.

2. The sound image localization apparatus according to claim 1, further comprising attenuation means for attenuating the audio signal outputted from the third signal processing means.

3. A sound image localization apparatus, comprising:

first signal processing means for convoluting an input audio signal with a first impulse response corresponding to a path, from a reference sound source position to a listener's left ear to generate a first audio signal for localization;

second signal processing means for convoluting the input audio signal with a second impulse response corresponding to a path from the reference sound source position to the listener's right ear to generate a second audio signal for localization;

third signal processing means for applying a third impulse response, other than the first and second impulse responses, so as to localize a sound image obtained by reproducing the first and second audio signals for localization at a position different from the reference sound source position; and delay means for delaying and outputting the input audio signal by an amount corresponding to the third impulse response, wherein:

the third signal processing means is operable to convolute the input audio signal with the third impulse response and output an input audio signal;

the first and second signal processing means are operable to convolute the input audio signal output from the delay means, with the first and second impulse responses, respectively, to generate the first and second audio signals for localization;

the audio signal outputted from the third signal processing means is added to each of the first and second audio signals for localization, and the first impulse response and the second impulse response form horizontal-direction localization and the third impulse response forms vertical-direction localization such that the first signal processing means and the second signal processing means perform horizontal-direction localization of the sound image and the third signal processing means performs vertical-direction localization of the sound image.

4. The sound image localization apparatus according to claim 3, comprising attenuation means for attenuating the audio signal outputted from the third signal processing means.

5. A sound image localization method, comprising a localization position changing step of convoluting an input audio signal with a first impulse response corresponding to a path from a reference sound source position to a listener's left ear, with a second impulse response corresponding to a path from the reference sound source position to the listene's right ear, and with a third impulse response, so as to localize a reproduced sound image at a position different from the reference sound source position, wherein the localization position changing step includes:

a change processing step of convoluting the input audio signal with the third impulse response and outputting an audio signal; and a localization processing step of convoluting the audio signal with the first and second impulse responses to generate first and second audio signals for localization, in which the first impulse response and the second impulse response form horizontal-direction localization and the third impulse response forms vertical-direction localization such that the localization processing step of convoluting performs horizontal-direction localization of the sound image and the change processing step of convoluting performs vertical-direction localization of the sound image.

6. The sound image localization method according to claim 5, further comprising an attenuation processing step of attenuating the audio signal, between the change processing step and the localization processing step.

7. A sound image localization method, comprising a localization position changing step of convoluting an input audio signal with a first impulse response corresponding to a path from a reference sound source position to a listener's left ear, with a second impulse response corresponding to a path from the reference sound source position to the listener's right ear, and with a third impulse response, so as to localize a reproduced sound image at a position different from the reference sound source position, wherein the localization position changing step comprises:

a change processing step of convoluting the input audio signal with the third impulse response and outputting an audio signal; and a delay processing step of delaying the input audio signal by an amount corresponding to the third impulse response and outputting a delayed audio signal;

a localization processing step of convoluting the delayed audio signal with the first and second impulse responses to generate first and second audio signals for localization; and an addition processing step of adding the audio signal to each of the first and second audio signals for localization and outputting the summed signals, in which the first impulse response and the second impulse response form horizontal-direction localization and the third impulse response forms vertical-direction localization such that the localization processing step of convoluting performs horizontal-direction localization of the sound image and the change processing step of convoluting performs vertical-direction localization of the sound image.

8. The sound image localization method according to claim 7, comprising an attenuation processing step of attenuating the audio signals, between the change processing step and the addition processing step.

9. A storage medium storing a sound image localization program for causing an information processor to localize a sound image, the sound image localization program comprising a localization position changing step of convoluting an input audio signal with a first impulse response corresponding to a path from a reference sound source position to a listener's left ear, with a second impulse response corresponding to a path from the reference sound source position to the listener's right ear, and with a third impulse response, so as to localize a reproduced sound image at a position different from a reference sound source position, wherein the localization position changing step includes:

a change processing step of convoluting an input audio signal with the third impulse response and outputting an audio signal; and a localization processing step of convoluting the audio signal with the first and second impulse, responses to generate first and second audio signals for localization, in which the first impulse response and the second impulse response form horizontal-direction localization and the third impulse response forms vertical-direction localization such that the localization processing step of convoluting performs horizontal-direction localization of the sound image and the change processing step of convoluting performs vertical-direction localization of the sound image.

10. The recording medium according to claim 9, further comprising an attenuation processing step of attenuating the audio signal, between the change processing step and the localization processing step.

11. A storage medium storing a sound image localization program for causing an information processor to localize a sound image, the sound image localization program comprising a localization position changing step of convoluting an input audio signal with a first impulse response corresponding to a path from a reference sound source position to a listener's left ear, with a second impulse response corresponding to a path from the reference sound source position to the listener's right ear, and with a third impulse response, so as to localize a reproduced sound image at a position different from a reference sound source position, wherein the localization position changing step comprises:

a change processing step of convoluting an input audio signal with the third impulse response and outputting an audio signal;

a delay processing step of delaying the input audio signal by an amount corresponding to the third impulse response and outputting a delayed audio signal;

a localization processing step of convoluting the delayed audio signal with the first and second impulse responses to generate first and second audio signals for localization; and an addition processing step of adding the audio signal to each of the first and second audio signals for localization and outputs the summed signals, in which the first impulse response and the second impulse response form horizontal-direction localization and the third impulse response forms vertical-direction localization such that the localization processing step of convoluting performs horizontal-direction localization of the sound image and the change processing step of convoluting performs vertical-direction localization of the sound image.

12. The recording medium according to claim 11, wherein the localization position changing step further comprises an attenuation processing step of attenuating the audio signal, between the change processing step and the addition processing step.

* * * * *